US005638105A

United States Patent [19]

Murata et al.

[11] Patent Number: 5,638,105

[45] Date of Patent: Jun. 10, 1997

[54] ERASING METHOD FOR IMAGE RECORDED ON REVERSIBLE HEAT-SENSITIVE RECORDING MEDIUM

[75] Inventors: Chikara Murata; Kensaku Higashi, both of Shizuoka, Japan

[73] Assignee: Tomoegawa Paper Co., Ltd., Tokyo, Japan

[21] Appl. No.: 635,787

[22] Filed: Apr. 22, 1996

Related U.S. Application Data

[63] Continuation of Ser. No. 187,720, Jan. 28, 1994, abandoned.

[30] Foreign Application Priority Data

Jan. 29, 1993 [JP] Japan ..... 5-32441

[51] Int. Cl.[6] ..... B41J 2/32

[52] U.S. Cl. ..... 347/171; 347/221

[58] Field of Search ..... 347/211, 171, 347/221; 346/135.1

[56] References Cited

FOREIGN PATENT DOCUMENTS

| | | |
|---|---|---|
| 0273738 | 7/1988 | European Pat. Off. . |
| 0461606 | 12/1991 | European Pat. Off. . |
| 4200474 | 7/1992 | Germany . |
| 55-154198 | 12/1980 | Japan . |
| 57-8993 | 1/1982 | Japan . |
| 57-94780 | 6/1982 | Japan . |
| 57-204580 | 12/1982 | Japan . |
| 62-257883 | 11/1987 | Japan . |
| 0050897 | 2/1990 | Japan . |
| 3-180388 | 8/1991 | Japan . |
| 4-197658 | 7/1992 | Japan . |
| 0301483 | 10/1992 | Japan . |

*Primary Examiner*—Huan H. Tran

*Attorney, Agent, or Firm*—Oblon, Spivak, McClelland, Maier & Neustadt, P.C.

[57] ABSTRACT

An erasure method for an image recorded on a reversible heat-sensitive recording medium comprising the step of contacting a thermal head to apply an amount of heat as an electric wave pulse to the recorded image in a heat-sensitive recording layer, characterized in that the amount of heat as pulse waves satisfies the following formula (1)

$$E_{(n-1)th} > E_{(n)th} \quad (1)$$

wherein $E_{(n)th}$ indicates an amount of heat applied to one dot of the thermal head the nth time, $E_{(n-1)th}$ indicates an amount of heat applied to one dot of the thermal head the (n−1)th time, and $n$ indicates a number of times the amount of heat is applied, and is an integer greater than 2.

11 Claims, 1 Drawing Sheet

ERASING METHOD FOR IMAGE RECORDED ON REVERSIBLE HEAT-SENSITIVE RECORDING MEDIUM

This application is a Continuation of application Ser. No. 08/187,720, filed on Jan. 28, 1994, now abandoned.

BACKGROUND OF THE INVENTION

The present invention relates to an erasing method for an image recorded on a heat-sensitive recording medium used for prepaid cards and the like, which can be recorded on and later have the images erased by making use of a reversible transparency change dependent on temperature.

With the growth of the information society, recording media use many recording methods such as heat-sensitive recording, electrostatic recording, sparking recording, and electrophotography, have increased. When the media were recorded on once, the recorded images were maintained for predetermined periods. However, most of these recording media cannot be recorded on and erased repeatedly. Therefore, the media were treated as disposable goods, and were disposed of after use.

However, recently, many people believe that resources should not be wasted and that the environment should not be degraded. Therefore, it is hoped that recording media could be developed on which images could be recorded and erased repeatedly.

The recording media on which images can be recorded and erased repeatedly were disclosed in Japanese Patent Application, First Publication (Kokai), Sho 55-154198, and Japanese Patent Application, First Publication (Kokai), Sho 62-257883. The images recorded on the recording media can be recorded and erased by heating the medium, and the recorded images are stable at room temperature.

Recording/Erasing machines and thermal heads for the reversible heat-sensitive recording media were disclosed in Japanese Patent Application, First Publication (Kokai), Sho 57-8993 and Japanese Patent Application, First Publication (Kokai), Sho 57-94780, Japanese Patent Application, First Publication (Kokai), Sho 57-204580, and Japanese Patent Application, First Publication (Kokai), Hei 4-197658.

In these machines, to one dot of the thermal head is applied an amount of heat by an electric wave pulse. Images were erased by touching the thermal head to the image. In this case, the temperature gradient between the surface and deeper layers of the heat-sensitive recording layer of the reversible heat-sensitive recording medium becomes large, and the temperature of the heat-sensitive recording layer becomes in part outside of the transparent temperature range. Therefore, the heat-sensitive recording layer was treated so that the image was erased, although the heat-sensitive recording layer was maintained in an opaque state (milky white state) and the image was not erased adequately. In particular, a machine for prepaid cards, or tickets, such as a ticket machine, which must record at high speeds, has this problem.

SUMMARY OF THE INVENTION

The object of the present invention is to provide a thermal erasing method, wherein an image can be erased by a thermal head which can effectively erase the image recorded on a reversible heat-sensitive recording medium.

Referring to FIG. 1, explanation of the relationship between the optical reflection density of the reversible heat-sensitive recording medium and the history of the heat applied to said medium is as follows.

In FIG. 1, a opaque state (1) becomes a transparent state (6) by heating the heat-sensitive recording layer to within a range of $T_1$ to $T_2$ (=transparent range (5)) and by cooling to room temperature $T_R$. This heat history is shown as (1)–(3)–(5)–(6).

In contrast, the transparent state (6) becomes the opaque state (1) by heating the heat-sensitive recording layer to more than $T_3$ (=an opaque temperature range (4)) and by cooling to room temperature $T_R$. This heat history can be shown as (6)–(5)–(4)–(2)–(1).

The transparent state (6) and opaque state (1) are both stable at room temperature $T_R$.

According to a first aspect of the present invention, a thermal erasing method is provided, comprising the step of contacting a thermal head to apply an amount heat as an electric wave pulse to a recorded image of a heat-sensitive recording layer, characterized in that the amount of heat as an electric wave pulse is satisfied by following formula (1)

$$E_{(n-1)th} > E_{(n)th} \quad (1)$$

wherein $E_{(n)th}$ indicates an amount of heat applied to one dot of the thermal head n times $E_{(n-1)th}$ indicates an amount of heat applied to one dot of the thermal head the (n−1)th time $n$ indicates the number of times the amount of heat is applied, and is an integer greater than 2.

The term "contacting" herein means contacting and positioning the head relative to the heat-sensitive recording medium at a distance at which no significant heat loss will occur.

DETAILED DESCRIPTION OF THE PREFERRED EMBODIMENT

Detailed description of the thermal erasing method of the present invention follows.

Hereinbelow "heat-sensitive recording medium having thermally reversible transparency" means a heat-sensitive recording medium having the following properties.

1 Transparency of the heat-sensitive recording medium heated once ($T_1$ to $T_2$=transparency range (5)) and cooled at approximately room temperature ($T_R$) differs from the transparency before heating.

2 Transparency of the heat-sensitive recording medium heated to a temperature higher than that of the above process (more than $T_3$) is comparable to that before heating.

3 The transparent state and the opaque state of the heat-sensitive recording medium are reversible.

In general, the difference in optical reflection density between a recorded part and another transparent part, that is, the contrast, is preferably more than 0.7.

The term "erasing" in the present application means to make the part of the heat-sensitive recording medium containing the image transparent by contacting the thermal head to apply an amount of heat to the reversible heat-sensitive recording medium.

Explanation of recording and erasing methods for an image on the reversible heat-sensitive recording medium follows.

In the present invention, a thermal head, such as a thick-film type, a thin-film type, a plane type, an end type, and the like is generally used.

In order to record an image on a part of the reversible heat-sensitive recording medium, a thermal head applies an amount of heat by contacting the part of the medium containing the image, so that the temperature of the layer falls in the range (more than $T_3$) shown in FIG. 1 in which the recording layer is opaque.

The image is also erased by the thermal head. In erasing the image, the amount of heat applied to the thermal head should be satisfied by the following formula (1)

$$E_{(n-1)th}>E_{(n)th} \quad (1)$$

wherein $E_{(n)th}$ indicates an amount of heat applied to one dot of the thermal head the nth time $E_{(n-1)th}$ indicates an amount of heat applied to one dot of the thermal head the (n−1)th time $_n$ indicates number of times the amount of heat is applied, and is an integer greater than 2.

Erasure of the image is carried out by contacting the thermal head to the image.

When the amount of heat does not satisfy the above formula (1), if treatments are carried out to erase the image, the recorded part is maintained in an opaque state. The image cannot be erased perfectly. Therefore, the above formula (1) must be satisfied.

The term "amount of heat (E)" in the present application satisfies the following formula (2).

$$E=(V^2/R)\times\Delta t \quad (2)$$

wherein

V indicates an applied voltage of the thermal head,

R indicates a resistance of the thermal head,

Δt indicates the duration of applying the amount of heat to the reversible heat-sensitive recording medium by the thermal head.

An amount of heat needed to erase an image cannot be prescribed as it is dependent on the type of material comprising the reversible heat-sensitive recording medium and the mixing ratios of these materials. However, in consideration of the durability of the protective layer and the thermal head, the amount of heat is preferably in the range of 0.1 to 1.0 mj/dot. In treatment conditions in machines such as ticket machines, the duration of applying an amount of heat (Δt) is preferably in the range of 0.5 ms to 3.0 ms. When the amount of heat and duration of applying the amount of heat are selected from the preferable range, the applied voltage and the resistance of thermal head can be calculated from the above formula (2).

In the case of applying the amount of heat to the reversible heat-sensitive recording medium by the thermal head, the treatment is carried out briefly. Therefore, it is difficult to change the voltage and resistance of the thermal head. The amount of heat must therefore substantially be controlled by controlling the duration of application. When the value of $V^2/R$ is constant, E is proportional to Δt. Therefore in order to control the amount of heat applied to the recorded part in the method of the present invention, the duration of application should be controlled.

Moreover, in order to easily erase the image in the present invention, it is preferable to use more than two thermal heads. Because a plurality of thermal heads is used, it becomes easy to control the amounts of heat applied. In this case, the number of times the amount of heat is to be applied to these thermal head can be freely chosen. For example, one dot of an image can have heat applied to it one or more times. However, the amount of heat as an electric wave pulse should satisfy the formula $E_{n-1}>E_n$ as described above. Moreover, the amounts of heat should satisfy the following formula (3):

$$E_{N-1}>E_N \quad (3)$$

wherein $E_N$ indicates a first amount of heat which is applied to the Nth installed thermal head in the erasing order, and $E_{N-1}$ indicates the last amount of heat which is applied to the N−1th installed thermal head in the erasing order.

A reversible heat-sensitive recording media which may be used in the present invention is explained as follows.

The reversible heat-sensitive recording medium in which the transparency thereof can be changed by altering the temperature means a heat-sensitive recording medium satisfying the above-mentioned 3 properties. For example, such reversible heat-sensitive recording media are disclosed in Japanese Patent Application, First Publication (Kokai), Hei 3-180388. The reversible heat-sensitive recording medium disclosed therein can be used in the method of the present invention.

The reversible heat-sensitive recording medium comprises a substrate and a heat-sensitive recording layer. The heat-sensitive recording layer is comprised of an organic high molecular material and an organic low molecular material. The organic low molecular material is dispersed in the organic high molecular material.

The substrate is, for example, a film made of synthetic resin, a paper on which a surface coloring cover layer is formed, and a film made of synthetic resin mixed with coloring pigment such as carbon black, and the like. Moreover, a transparent film made of organic polymer resin such as vinyl chloride-vinyl acetate copolymer, polyethyleneterephtharate, polycarbonate, polyacetate, polyimide and the like, can be used. A transparent film having a metalized reflective layer can also be used.

A material having high transparency, high mechanical strength, and easy film-forming properties is preferable for the organic high molecular material included in the heat-sensitive recording layer. For example, polyvinyl chloride, vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, polyvinylidene chloride, vinylidene chloride-vinyl chloride copolymer, vinylidene chloride-acrylonitrile copolymer, polyester resin, polyamide resin, acrylic resin, silicone resin, and the like, may be used. In particular, vinyl chloride-vinyl acetate copolymer, vinyl chloride-vinyl acetate-maleic acid copolymer, vinyl chloride-vinyl acetate-vinyl alcohol copolymer, and polyester resin, are preferable. Among the organic high molecular materials, copolymers including 10 to 40 wt % of vinyl acetate, and copolymers in which the degree of polymerization is more than 1000, are most preferable, because these resins have good erasing properties and good durability after repeated use.

As the organic low molecular materials used in the present invention, there may be mentioned, for example, alkanol, alkanediol, halogenoalkanol, halogenoalkanediol, alkylamine, alkane, alkene, halogenoalkane, halogenoalkene, halogenoalkyne, cycloalkane, cycloalkene, cycloalkyne, and saturated or unsaturated monocarboxylic acid, saturated or unsaturated dicarboxylic acid and ester, amide and ammonium salt thereof, saturated or unsaturated halogenofatty acid and ester, amide and ammonium salt thereof, halogenoarylcarboxylic acid and ester, amide and ammonium salt thereof, thioalcohol, thiocarboxylic acid polymer and ester thereof, thiodicarboxylic acid, amide and ammonium salt thereof, carboxylate of thioalcohol, having 10 to 40 carbon atoms and molecular weights of 100 to 700. However, higher fatty acids of montanic acid, lauric acid, palmitic acid, stearic acid, arachic acid, behenic acid, and thiodicarboxylic acid, ester, amide, and ammonium salt thereof, which have melting points of 50° to 150° C. are preferable.

In addition, materials including long-chain alkyl group are most preferable. These materials are generally waxes and are solid at room temperature. The carbon number of the alkyl group is $C_{14}$ to $C_{50}$. Melting points of these materials are in the range of 50° to 100° C. In particular, an ester, amide, or ketone which has a long-chain alkyl group is preferable. As the ester thereof, there may be mentioned, for example, stearyl stearate, behenyl stearate, behenyl behenate, behenyl montarate, $C_{30}$ alcohol stearate, $C_{30}$ alcohol behenate, $C_{50}$ alcohol stearate, $C_{50}$ alcohol behenate, stearylalcoholdiester hypoeicosanate, and the like. As an amide thereof, there may be mentioned, for example, amide palmitate, amide stearate, amide behenate, amide oleate, amide N-stearylstearate, amide N-oleylpalmitate, amide N-stearyleruate, amide N-stearyl oleate, and the like. As an ketone thereof, there may be mentioned, for example, distearylketone, dibehenylketone, and the like.

Only one kind of these materials including long-chain alkyl group may be used; however, a mixture of two or more kinds of the aforementioned materials can also be used.

In addition, a saturated aliphatic bisamide is preferable for an organic low molecular material. In particular, an acid amide formed by a saturated fatty acid having a long chain and alkylenediamine, or formed by saturated aliphatic dicarboxylic acid and saturated aliphatic amine, which have melting points of more than 120° C., preferably in the range of 130° to 150° C. are preferable.

Representative examples of these materials include, but are not limited to:

amide N,N'-hypodistearyldodecanate m.p.: 130° C. $(C_{12}H_{25}CONH)_2(CH_2)_4$ amide ethylenebisstearate m.p.: 143° C. $(C_{17}H_{35}CONH)_2(CH_2)_2$ amide ethylenebisbehenate m.p.: 141° C. $(C_{21}H_{43}CONH)_2(CH_2)_2$ amide hexamethylenebisstearate m.p.: 146° C. $(C_{17}H_{35}CONH)_2(CH_2)_6$ amide hexamethylenebisbehenate m.p.: 143° C. $(C_{21}H_{43}CONH)_2(CH_2)_6$ amide N,N'-distearyladipate m.p.: 144° C. $(C_{18}H_{37}CONH)_2(CH_2)_4$ amide N,N'-hypodistearyleicosanate m.p.: 128° C. $(C_{18}H_{37}CONH)_2(CH_2)_{18}$ amide N,N'-distearylsebacate m.p.: 138° C. $(C_{12}H_{37}CONH)_2(CH_2)_8$ amide N,N'-hypodilauryldodecanate m.p.: 138° C. $(C_{12}H_{25}CONH)_2(CH_2)_{10}$ amide N,N'-hypodilauryleicosanate m.p.: 130° C. $(C_{12}H_{25}CONH)_2(CH_2)_{18}$ Only one kind of these saturated aliphatic bisamides may be used; however, a mixture of two or more kinds of the aforementioned materials can also be used.

Moreover, it is most preferable to mix the above-mentioned materials including the long-chain alkyl group and the saturated aliphatic bisamide, because the range of the transparent temperature of the heat-sensitive recording layer is widened. Preferable the weight ratio of the material including long-chain alkyl group and the saturated aliphatic bisamide is 98:2 to 80:20. When the ratio of saturated bisamide is under 2 weight %, the range of the transparent temperature cannot be widened. When the ratio of saturated bisamide is above 20 weight %, good contrast of the heat-sensitive recording layer cannot be obtained. Therefore, a ratio falling outside the above-mentioned range is not preferable.

The mixing weight ratio of the organic high molecular material and the organic low molecular material is preferably 100:5 to 100:200, and is more preferably 100:10 to 100:100. When the ratio of the organic low molecular material is under 5 weight %, good contrast in the heat-sensitive recording layer cannot be obtained, because the state of the heat-sensitive recording layer is not sufficiently in an opaque state. When the ratio of the organic low molecular material is above 200 weight %, the film-forming property becomes worse. Therefore, a ratio falling outside the above-mentioned range is not preferable.

In order to improve the heat-proof properties of the heat-sensitive recording layer and to maintain good contact between the thermal head, and to prevent the reversible heat-sensitive recording layer from loosing transparency due to repeated heating and cooling, it is possible to form a protective layer on the heated side of the reversible heat-sensitive recording medium.

For example, the protective layer can be made of thermoplastic resin and thermosetting resin such as polymethacrylate resin, silicone resin, acrylic resin, alkyl resin, optical- or electron-beam setting resin such as urethane-acrylate resin and the like.

It is possible to form the following layers, depending on the situation, in the reversible heat-sensitive recording medium of the present invention.

For example, a magnetic recording layer can be formed between the substrate and the heat-sensitive recording layer, or on the side of substrate on which the heat-sensitive recording layer is not formed.

An intermediate layer can be formed between the heat-sensitive recording layer and the protective layer, in order to prevent migration of the organic low molecular material of the heat-sensitive recording layer to another layer, and to improve the cohesion between these layer.

When the magnetic recording layer is formed, in order to protect the magnetic recording layer from mechanical abrasion, a protective layer may be formed on the magnetic recording layer. For example, the protective layer can be made of thermoplastic resin and thermosetting resin such as polymethacrylate resin, silicone resin, acrylic resin, alkyl resin, optical- or electron-beam setting resin such as urethane-acrylate resin, epoxy-acrylate resin and the like.

DESCRIPTION OF THE PREFERRED EMBODIMENT

Figure 1:
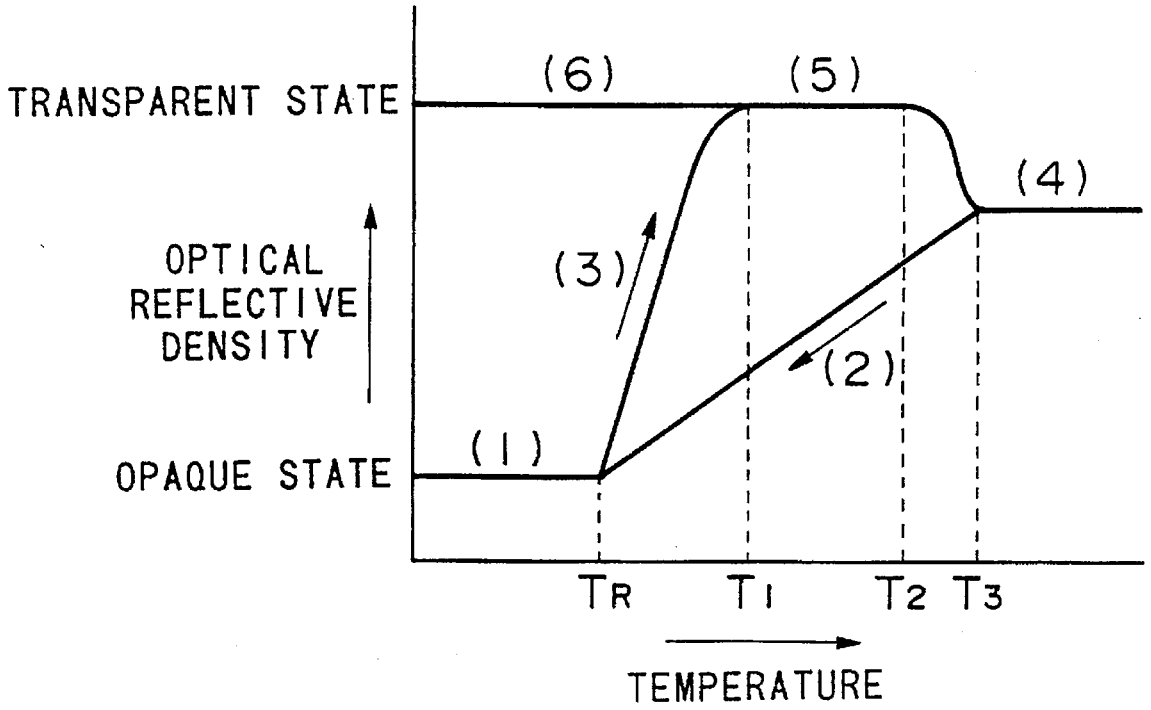
FIG. 1 shows the relationships between temperatures and transparencies, that is, the optical reflection densities of the reversible heat-sensitive recording medium.

The present invention will be explained in detail hereinbelow with reference to examples. In the examples, all "parts" designate "parts by weight".

EXAMPLE 1

Transparent polyethyleneterephtharate film having a thickness of 188 μm, on which aluminum was deposited by vacuum evaporation, was used as the substrate. The aluminum layer was used as a light reflective layer. In order to prepare the heat-sensitive recording layer, a solution for the heat-sensitive recording layer, having the compositions listed below, was applied by wire bar to the side of the substrate on which the aluminum layer was not formed; the solution was then dried. The obtained heat-sensitive recording layer had a thickness of 4 μm.

Solution for the heat-sensitive recording layer:

| | |
|---|---|
| behenyl monthanate | 95 parts |
| amide N,N'-hypodistearyldodecanate | 5 parts |
| vinyl chloride-vinyl acetate copolymer (85/15) (trade name: Denka Vinyl 1000LCH, marketed by Denki Kagaku Industry Co., glass-transition temperature: 65° C.) | 150 parts |
| vinyl chloride-vinyl acetate copolymer (60/40) (trade name: MPR-TS40, marketed by Nisshin Kagaku Co., glass-transition temperature: 53° C.) | 150 parts |
| tetrahydrofuran | 1600 parts |

The reversible heat-sensitive recording medium was produced by forming a protective layer. The protective layer was formed by applying a solution for the protective layer, having the compositions listed below, on the heat-sensitive recording layer, and then drying the solution. The solution was applied so that the amount of adhering solid was to 0.01 $g/m^2$ in the dried state.

Solution for the protective layer:

| | |
|---|---|
| silicone graft polymer (concentration: 30%, trade name: Aron XS705, marketed by Toa Gosei Kagaku Industry Co.) | 0.8 parts |
| high molecular cation conductive agent (concentration: 3%, trade name: Chemistat 6300, marketed by Sanyo Kasei Co.) | 0.7 parts |
| isopropylalcohol | 68 parts |
| water | 30 parts |

The optical reflection density of the reversible heat-sensitive recording medium prepared was evaluated by a Macbeth reflective densitometer (trade name RD-914, marketed by Macbeth Co.). The value (X) was established as an optical reflection density before recording. After evaluation, an image was formed in the heat-sensitive recording medium by contacting the thermal head (max heating value: 0.55 mj/dot, resistance: 400 ohm) with the heat-sensitive recording layer, and slowly cooling to room temperature, so that the recorded part was in an opaque state. The heat history of the reversible heat-sensitive recording medium is as shown as (6)–(5)–(4)–(2)–(1) in FIG. 1.

After that, the image was erased by contacting the thermal head to the image, and applying the amounts of heat of 0.30 mj, 0.15 mj, 0.10 mj to one dot of the thermal head in turn. Therefore, to the image was applied amounts of heat which became progressively smaller. At this time, the thin-film type thermal head (max heating value: 0.55 mj/dot, resistance: 400 ohm, dot density: 8/mm) was used.

After erasing, the optical reflection density (Y) of the obtained transparent part, that is, the erasing part, was evaluated.

The difference in optical reflection density between before recording and after erasing [(X)–(Y)] of the obtained reversible heat-sensitive recording medium was calculated, and shown in Table 1.

EXAMPLE 2

The reversible heat-sensitive recording medium recorded image which was obtained in Example 1 was used. The image of the reversible heat-sensitive recording medium was erased in the following manner. In erasing the image, two thermal heads, that is, a first thermal head (max heating value: 0.50 mj/dot, resistance: 350 ohm) and a second thermal head (max heating value: 0.30 mj/dot, resistance: 400 ohm) were used. First, the one dot of the first thermal head was contacted to one dot of the images; to the first thermal head was applied the amount of heat of 0.50 mj. Then one dot of the second thermal head was contacted to the same dot; to the second thermal head was applied the amount of heat of 0.30 mj.

After erasing, the optical reflection density (Y) of the obtained transparent part, that is, the erased part, was evaluated. The difference in optical reflection density of the obtained reversible heat-sensitive recording medium before recording and after erasing [(X)–(Y)] was calculated. The results are shown in Table 1.

EXAMPLE 3

The reversible heat-sensitive recording medium recorded image which was obtained in Example 1 was used. The image of the reversible heat-sensitive recording medium was erased in the following manner. In erasing the image, the two thermal heads in Example 2 were used. One dot of the first thermal head was contacted to one dot of the image; to the first thermal head was applied an amount of heat of 0.3 mj, and then was applied 0.2 mj. The second thermal head was then contacted to the same dot of the image; to the second thermal head was applied the amounts of heat of 0.15 mj, 0.10 mj, 0.05 mj.

After erasing, the optical reflection density (Y) of the obtained transparent part, that is, the erased part, was evaluated. The difference in optical reflection density of the obtained reversible heat-sensitive recording medium before recording and after erasing [(X)–(Y)] was calculated. The results are shown in Table 1.

EXAMPLE 4

An erasure of the image was carried out in a manner identical to that of Example 1 of the present invention. However, the reversible heat-sensitive recording medium in this Example was different from that of Example 1. In detail, the solution for heat-sensitive recording layer was different. The solution used in this Example had the composition listed below.

| | |
|---|---|
| stearic acid | 50 parts |
| hypoeicosanic acid | 50 parts |
| vinyl chloride-vinyl acetate copolymer (85/15) (trade name: Denka Vinyl 1000LCH, marketed by Denki Kagaku Industry Co., glass-transition temperature: 65° C.) | 390 parts |
| diisodecyl phtalate | 30 parts |
| tetrahydrofuran | 1000 parts |
| cyclohexanone | 650 parts |

EXAMPLE 5

An erasure of an image was carried out in a manner identical to that of Example 2, except that the solution for the heat-sensitive recording layer was replaced by a solution having the composition listed in Example 4.

EXAMPLE 6

An erasure of an image was carried out in a manner identical to that of Example 3, except that the solution for the heat-sensitive recording layer was replaced by a solution having the composition listed in Example 4.

EXAMPLE 7

An erasure of an image was carried out in a manner identical to that of Example 1 of the present invention. However, the reversible heat-sensitive recording medium of this Example was different from that of Example 1. In particular, the solution for the heat-sensitive recording layer was different. The solution used in this Example has the composition listed below.

| | |
|---|---|
| stearic acid | 30 parts |
| palmitic acid | 20 parts |
| hypoeicosanic acid | 50 parts |
| vinyl chloride-vinyl acetate copolymer (85/15) (trade name: Denka Vinyl 1000LCH, marketed by Denki Kagaku Industry Co., glass-transition temperature: 65° C.) | 390 parts |
| diisodecyl phtalate | 30 parts |
| tetrahydrofuran | 1000 parts |
| cyclohexanone | 650 parts |

EXAMPLE 8

An erasure of an image was carried out in a manner identical to that of Example 2, except that the solution for the heat-sensitive recording layer was replaced by a solution having the composition listed in Example 7.

EXAMPLE 9

An erasure of an image was carried out in a manner identical to that of Example 3, except that the solution for the heat-sensitive recording layer was replaced by a solution having the composition listed in Example 7.

EXAMPLE 10

An erasure of an image was carried out in a manner identical to that of Example 1 of the present invention. However, the reversible heat-sensitive recording medium of this Example was different from that of Example 1. In particular, the solution for the heat-sensitive recording layer was different. The solution used in this Example had the composition listed below.

| | |
|---|---|
| thiodipropionic acid | 70 parts |
| hypoeicosanic acid | 50 parts |
| vinyl chloride-vinyl acetate copolymer (86/14) (trade name: VYHH, marketed by UCC Co., glass-transition temperature: 72° C.) | 250 parts |
| di-2-ethylhexyl phtalate | 20 parts |
| tetrahydrofuran | 1200 parts |

EXAMPLE 11

An erasure of an image was carried out in a manner identical to that of Example 2, except that the solution for the heat-sensitive recording layer was replaced by a solution having the composition listed in Example 10.

EXAMPLE 12

An erasure of an image was carried out in a manner identical to that of Example 3, except that the solution for the heat-sensitive recording layer was replaced by a solution having the composition listed in Example 10.

COMPARATIVE EXAMPLE

In this Comparative Example, the reversible heat-sensitive recording medium was the same as that used in Example 1.

A recording of an image was carried out in a manner identical to that of Example 1. The image was erased by applying one pulse to each dot of the image. The applied amount of heat was 0.50 mj in each wave pulse.

The difference between the optical reflection density of the obtained reversible heat-sensitive recording medium before recording and after erasure [(X)–(Y)] was calculated. The results are shown in Table 1.

TABLE 1

| | Optical Reflective Density | | |
|---|---|---|---|
| | Before Recording (X) | After Erasing (Y) | (X) – (Y) |
| Example 1 | 1.33 | 1.33 | 0.00 |
| Example 2 | 1.33 | 1.33 | 0.00 |
| Example 3 | 1.33 | 1.33 | 0.00 |
| Example 4 | 1.28 | 1.26 | 0.02 |
| Example 5 | 1.28 | 1.28 | 0.00 |
| Example 6 | 1.28 | 1.28 | 0.00 |
| Example 7 | 1.22 | 1.20 | 0.02 |
| Example 8 | 1.23 | 1.22 | 0.01 |
| Example 9 | 1.22 | 1.22 | 0.00 |
| Example 10 | 1.30 | 1.27 | 0.03 |
| Example 11 | 1.30 | 1.29 | 0.01 |
| Example 12 | 1.31 | 1.29 | 0.02 |
| Comparative Example | 1.33 | 0.71 | 0.62 |

As shown in Table 1, there is no difference in optical reflection density in the obtained reversible heat-sensitive recording medium between the medium before recording and after erasure [(X)–(Y)]. Therefore, it is confirmed that it is possible to obtain good erasure properties when erasing an image by the method of the present invention.

What is claimed is:

1. An erasure method for an image recorded on a heat-sensitive recording layer consisting essentially of at least one organic low molecular weight material dispersed within at least one organic high molecular weight material, of a reversible heat-sensitive recording medium comprising the step of contacting at least one thermal head to the recorded image on the reversible heat-sensitive recording medium to apply amounts of heat a number of times (n) in n electric wave pulses to the recorded image in the heat-sensitive recording layer, characterized in that said amounts of heat as electric wave pulses satisfy the following formula (1):

$$E_{(n-1)th} > E_{(n)th} \quad (1)$$

wherein $E_{(n)th}$ indicates an amount of heat applied to one dot of the thermal head the nth time $E_{(n-1)th}$ indicates an amount of heat applied to one dot of the thermal head the (n–1)th time $_n$ indicates the number of times the amounts of heat are applied, and is an integer greater than 2.

2. An erasure method for an image recorded on a reversible heat-sensitive recording layer of a reversible heat-sensitive recording medium comprising the step of contacting a plurality of thermal heads to the recorded image on the reversible heat-sensitive recording medium to apply amounts of heat a number of times (n) in n electric wave pulses to the recorded image in the heat-sensitive recording layer, characterized in that said amounts of heat as electric wave pulses satisfy the following formula (1)

$$E_{(n-1)th} > E_{(n)th} \quad (1)$$

wherein $E_{(n)th}$ indicates an amount of heat applied to one dot of the thermal head the nth time $E_{(n-1)th}$ indicates an amount of heat applied to one dot of the thermal head the (n−1)th time $_n$ indicates the number of times the amounts of heat are applied, and is an integer greater than 2.

3. An erasure method for an image recorded on a reversible heat-sensitive recording medium in accordance with claim 1, characterized in that the amounts of heat applied to the at least one thermal head each time is in the range of 0.1 to 1.0 mj/dot.

4. An erasure method for an image recorded on a reversible heat-sensitive recording medium in accordance with claim 1, characterized in that said amounts of heat are applied to the at least one thermal head for 0.5 ms to 3.0 ms each time.

5. An erasure method for an image recorded on a reversible heat-sensitive recording medium in accordance with claim 2, characterized in that the amounts of heat applied satisfy the following formula (3):

$$E_{N-1} > E_N \quad (3)$$

wherein $E_N$ indicates a first amount of heat which is applied to the Nth installed thermal head in erasing order $E_{N-1}$ indicates a last amount of heat which is applied to the N−1th installed thermal head in erasing order.

6. An erasure method for an image recorded on a reversible recording medium in accordance with claim 1, wherein the at least one organic high molecular weight material comprises a copolymer having 10 to 40 weight % of vinyl acetate.

7. An erasure method for an image recorded on a reversible recording medium in accordance with claim 1, wherein the at least one organic high molecular weight material comprises a copolymer having polymerization of more than 1000.

8. An erasure method for an image recorded on a reversible recording medium in accordance with claim 1, wherein the at least one organic low molecular weight material comprises a material including a long-chain alkyl group.

9. An erasure method for an image recorded on a reversible recording medium in accordance with claim 1, wherein the at least one organic low molecular weight material comprises a wax.

10. An erasure method for an image recorded on a reversible recording medium in accordance with claim 1, wherein the at least one organic low molecular weight material comprises a saturated aliphatic bisamide.

11. An erasure method for an image recorded on a reversible recording medium in accordance with claim 1, wherein the at least one organic low molecular weight material comprises a mixture of a long-chain alkyl group-containing compound and a saturated aliphatic bisamide.

* * * * *